United States Patent [19]

Harper, Jr. et al.

[11] Patent Number: 5,000,157

[45] Date of Patent: Mar. 19, 1991

[54] HEATER FOR COOKING APPARATUS

[75] Inventors: John M. Harper, Jr., Indianapolis; Wallace E. Schmidt, Carmel; Stanley H. Beach, Indianapolis, all of Ind.

[73] Assignee: Maytag Corporation, Newton, Iowa

[21] Appl. No.: 493,836

[22] Filed: Mar. 1, 1990

[51] Int. Cl.[5] ..... F24C 3/00

[52] U.S. Cl. ..... 126/41 R; 126/39 E

[58] Field of Search ..... 126/39 E, 41 R, 40, 126/91 R, 91 A, 92 B, 92 A; 431/154, 326, 347; 99/447

[56] References Cited

U.S. PATENT DOCUMENTS 4,413,610 11/1983 Berlik .
4,416,249 11/1983 Reynolds ..... 126/41 R
4,587,948 5/1986 Haglund ..... 126/41 R X
4,690,125 9/1987 Beller ..... 126/25 R X
4,705,020 11/1987 Hahn ..... 126/41 R
4,750,470 6/1988 Beach et al. .

*Primary Examiner*—Larry Jones

*Attorney, Agent, or Firm*—Willian Brinks Olds Hofer Gilson & Lione

[57] ABSTRACT

A cooking apparatus includes a heater with high heat output and a baffle carried outwardly of the heater on at least one side thereof to intercept substantially the heat radiated in the direction of the baffle and to increase the flexibility in the installation of the cooking apparatus. The heater and baffle can be combined in a removable unit that is particularly adapted for grilling foods in a proximity ventilated cooktop and the baffle can be located in the air flow generated in the operation of the apparatus.

23 Claims, 5 Drawing Sheets

HEATER FOR COOKING APPARATUS

FIELD OF THE INVENTION

This invention relates to a heater for a cooking apparatus and more particularly to removable, effective grilling means for a downdraft proximity ventilated grill- range.

BACKGROUND ART

Proximity ventilated grill-ranges are known in the art. For example, a gas downdraft grill-range is shown and described in U.S. Pat. No. 4,413,610 issued Nov. 8, 1983 to Berlik. In this prior gas downdraft grill-range, modular cooking units or cartridges are utilized and the grill unit includes a pair of centrally located tubular burners which extend from front to rear within the grill cartridge.

More recently, as shown and described in U.S. Pat. No. 4,750,470, grill ranges have been improved by the provision of a gas burner which is constructed and disposed within a burner pan to produce non-uniform heat output relative to the front-to-rear center line of the burner pan and with greater heat output close to the burner pan side wall opposite the intake of the proximity ventilation system. The positioning and construction of the heater and a grill grate, which is designed to control the volume of combustion air entering the burner pan, provide for controlled heating with the proximity ventilation system in operation.

In the improved grill range of U.S. Pat. No. 4,750,470, a housing defines a burner pan having first and second side walls spaced laterally from the front-to-rear center line. The proximity ventilation system has an air inlet extending along the first side wall of the burner pan. The grill grate includes upwardly directed openings overlying the burner pan. The gas burner is mountable within the burner pan and is constructed and disposed within the burner pan to produce non-uniform heat output relative to the front-to-rear center line, with greater heat output being produced relatively closer to the second side wall of the burner pan, which is located opposite the exhaust air inlet.

A burner support structure is provided for mounting the burner in the burner pan. The burner support structure includes bracket having first and second bracket portions which are utilized in mounting the burner within the burner pan. The first bracket portion includes an elongated, inverted, L-shaped section which extends generally horizontally along, and is welded or otherwise secured to, the bottom of the gas burner. The downwardly-extending, vertical leg of the inverted L-shaped section defines a baffle or deflector which extends parallel to the body of the burner. The first bracket portion further includes a first arm formed from inverted V-shaped channel stock for promoting grease drainage. This arm is joined to and extends outwardly in a substantially perpendicular direction from the inverted L-shaped section of the bracket. The first arm has a downwardly-turned mounting tab which includes a downwardly-opening slot for receiving a first mounting stud attached to the second side wall of the burner pan. The second bracket portion is likewise secured to the bottom of the gas burner and includes a second arm also formed from inverted V-shaped channel stock. The second bracket portion extends outwardly from the gas burner and has a downwardly opening slot for receiving a mounting stud attached to the first side wall of the burner pan.

As indicated above, the first bracket portion of the supporting bracket for the burner includes an elongated, downwardly-extending, L-shaped section which forms a baffle or deflector extending parallel to the body of the burner. The baffle or deflector retards airflow adjacent the second side wall of the burner pan to achieve improved flame characteristics adjacent the baffle for retaining maximum heat in the vicinity of the main body portion of the burner. In other words, the baffle or deflector prevents the flame from being pulled under the burner by the velocity of combustion air pulled into the burner pan through openings therein. This permits convective heat thermals to rise in a substantially vertical path in the area superadjacent the burner. In addition, cast aluminum grates are provided which include front-to-rear extending upwardly projecting ribs. As air is drawn from the surface of the grates, the rib closest to the second wall of the burner will initially retard and deflect the air in an upward direction to enhance the convective airflow above the grill burner unit. The relatively thick section or depth of the horizontal grill grate ribs slow the rate of vertical airflow from the burner pan and retard the velocity of air pulled from the surface of the grill grates toward the air inlet of the proximity ventilation system. In addition, the arrangement of the grill grate openings and the baffle or deflector associated with the burner combine to provide increased heating at the second side of the burner pan, and fast, uniform, convective cooking at less than maximum burner settings.

Increased industry activity has been directed to reducing temperatures at the countertop adjacent to cooktops without curtailing their effectiveness, to permit greater flexibility in the installation of cooktops, especially in their spacing from walls and other cabinets.

DISCLOSURE OF THE INVENTION

A cooking apparatus of the invention includes a housing defining a burner pan with first and second side walls, proximity ventilation means having an air inlet extending along the first side wall, a heater mounted within the burner pan and adapted to produce a non-uniform heat output with higher heat output adjacent the second side wall, and baffle means supported in said burner pan intermediate and spaced from the heater and the second side wall. The baffle means extends substantially coextensive with the length and height of the heater and interacts with the heater and second side wall to provide effective uniform grilling and thermal isolation of the apparatus housing from the heater.

The cooking apparatus of the invention preferably includes a removable heater assembly in which the baffle means is carried by the heater on the higher heat output side of the heater in a position intermediate the heater and the second side of the burner pan and is adapted to intercept heat radiated by the heater and to control, and be cooled by, the flow of air generated by operation of the heater. In such an assembly, the baffle means is carried by the heater outwardly of the heater, extending substantially the entire width and height of the heater on the high heat output side of the heater, and can provide means to support the removable heater assembly in the cooking apparatus. For example, the baffle means can be formed with a long, flat metal plate supported from the heater by supporting means of reduced thermal conductivity and provided with a slot adapted to engage a projection from the second wall of the burner pan.

Other features and advantages of the invention will be apparent from the drawings and description that follow.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
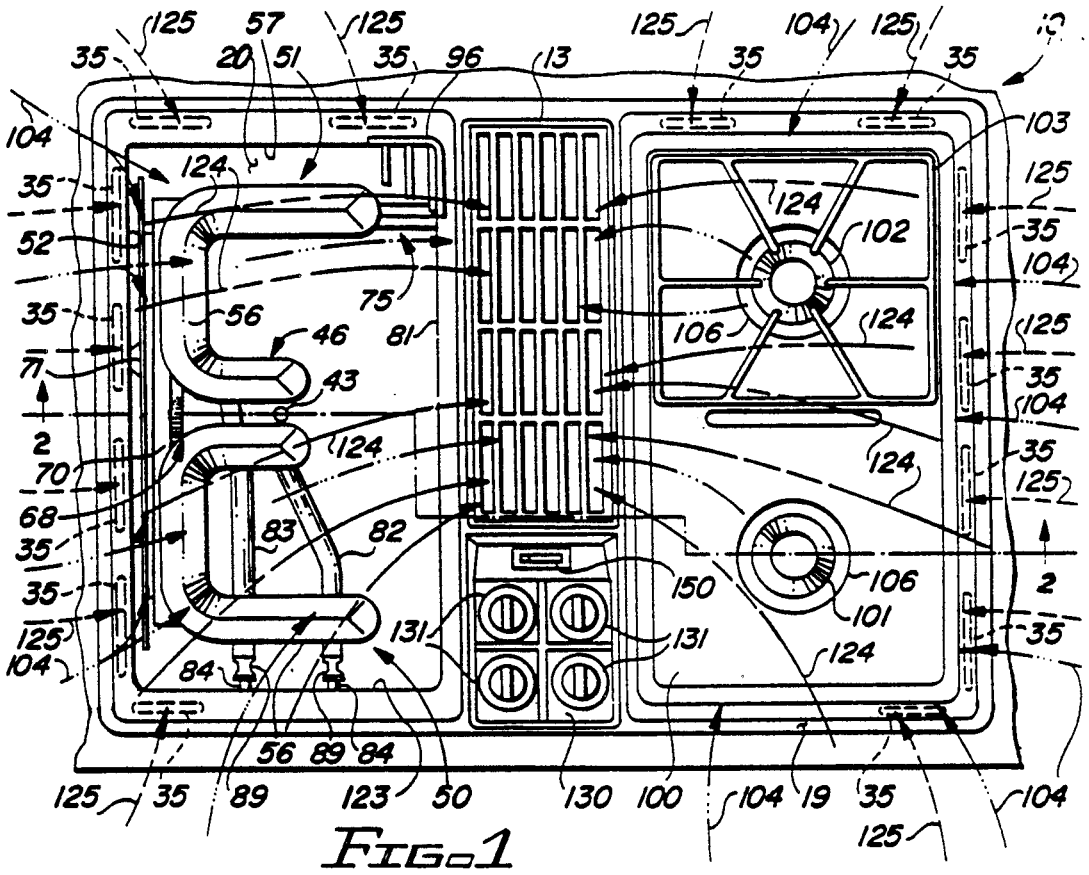
FIG. 1 is a top plan view of a gas downdraft countertop cooking unit of the invention.
Figure 12:
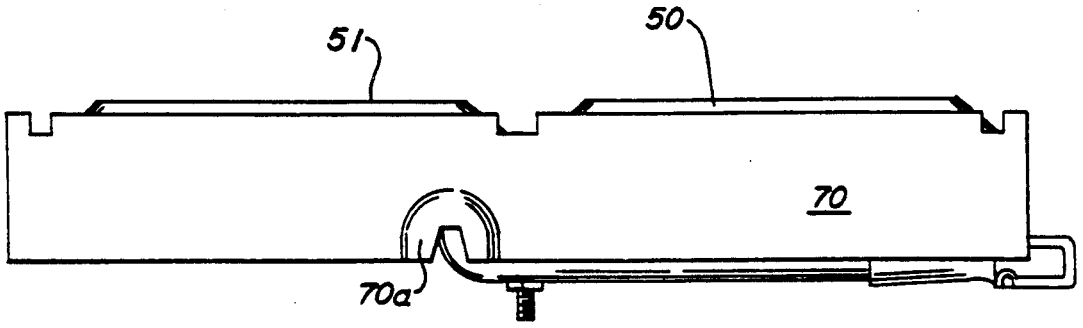
FIG. 12 is a side view of the grill burner assembly of FIG. 9 removed from the cooking unit and taken generally along lines 12—12 of FIG. 9.
Figures 2, 4, 5:
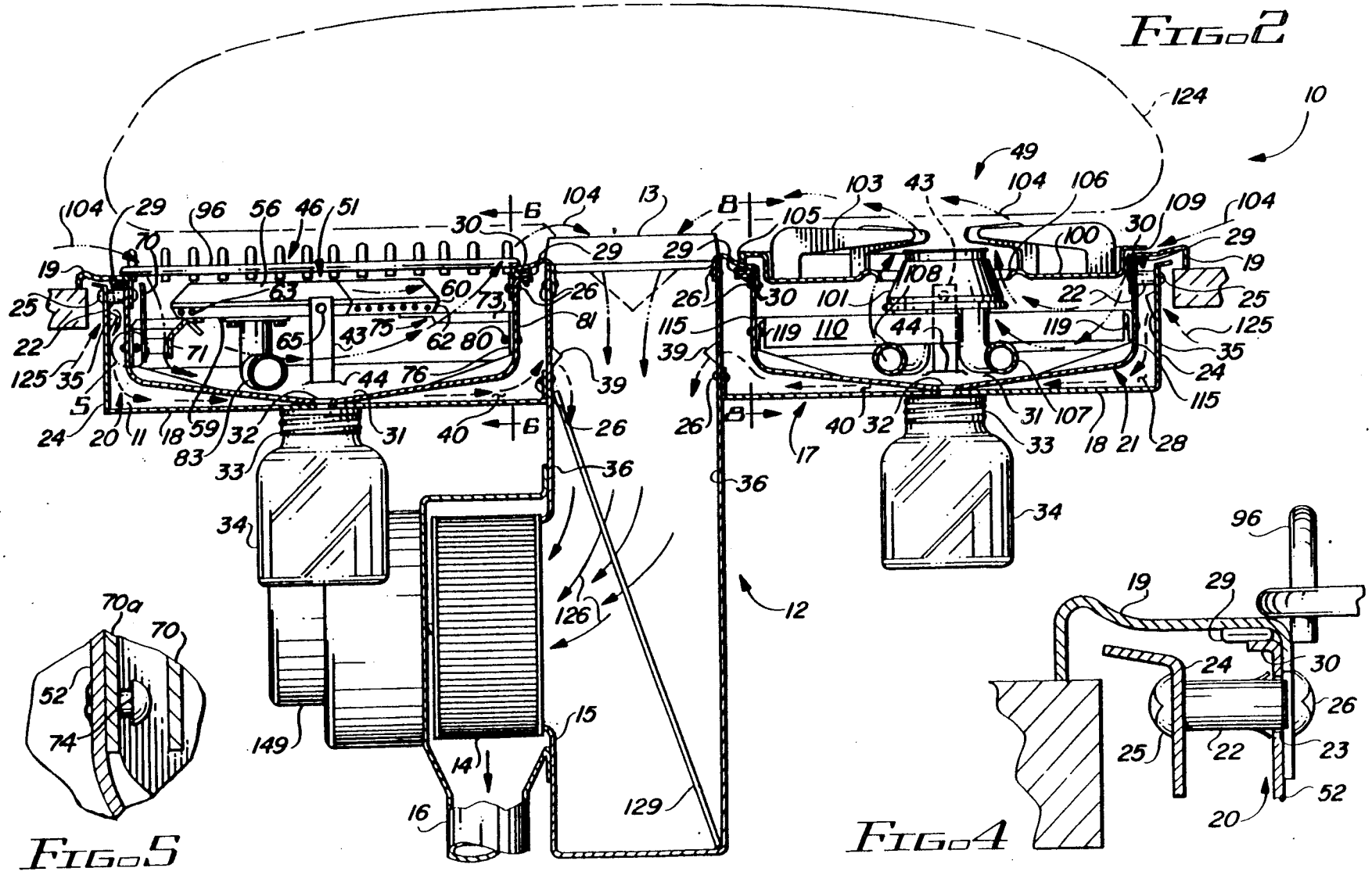
FIG. 2 is a section view taken generally along lines 2—2 of FIG. 1.
FIG. 4, shown with FIG. 2, is an enlarged fragmentary section view showing the attachment of the burner box and cover to the burner pans.
FIG. 5, shown with FIG. 2, is an enlarged fragmentary section view showing a preferred mounting support arrangement for burner assemblies of the invention within the burner pans.

FIGS. 1 and 2 show a preferred embodiment of a drop-in countertop cooking unit 10 of the invention. The concepts embodied in the drop-in countertop cooking unit 10 of this preferred embodiment can also be applied to free-standing or built-in type gas cooking ranges.

Figure 3:
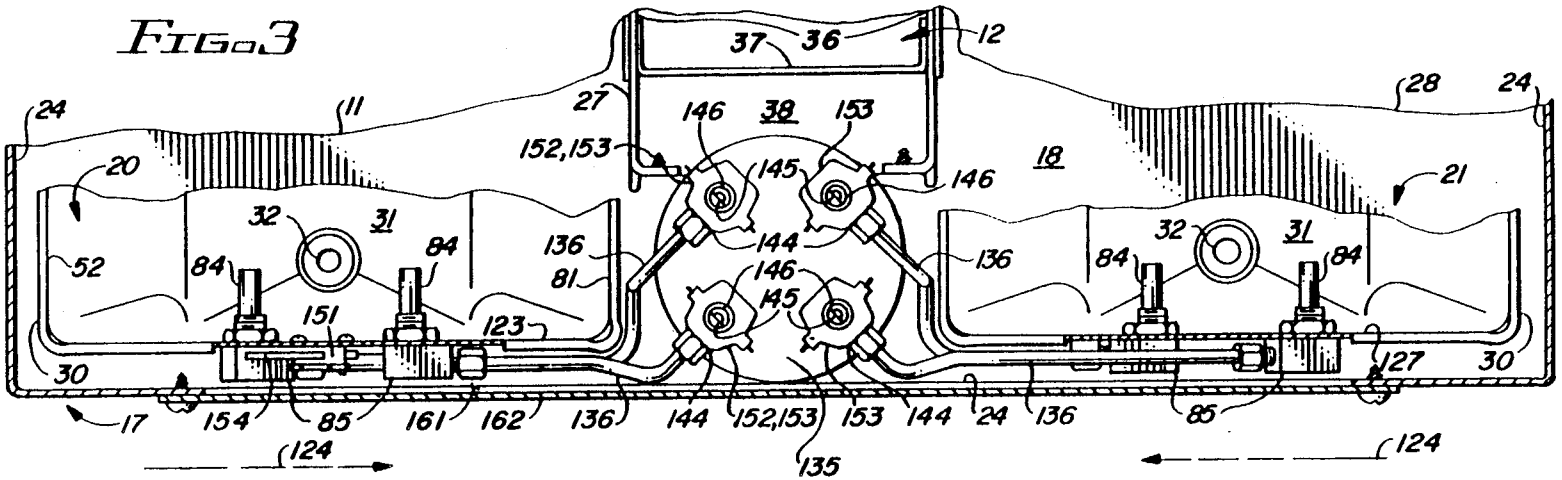
FIG. 3 is a top plan view showing the gas distribution system of the cooking unit of FIG. 1.

As shown in FIGS. 2, 3, 6 and 8, the countertop cooking unit 10 includes a sheet metal housing 17 having a bottom wall 18 and upwardly extending side walls numbered 24. As best shown in FIGS. 2 and 3, the bottom wall 18 of the housing 17 has a substantially rectangular opening 27 in the central portion thereof for receiving a rectangular exhaust enclosure 12. The exhaust or plenum closure 12 is front-to-rear elongated and effectively divides the housing 17 into left and right burner boxes 11 and 28. The exhaust enclosure 12 includes an elongated air intake opening at the top which defines the entrance thereto. An exhaust blower 14 is located adjacent the exhaust opening 15 of the exhaust enclosure 12 and is connected to atmosphere via the duct 16.

As shown in FIGS. 1 and 2, a frame-like cover 19 generally overlies the housing 17 and the exhaust enclosure 12 and, as shown in FIG. 4, is rigidly attached to the side walls 24 of the housing 17 and to the left and right burner pans 20 and 21 as will be further discussed herein. The cover 19 includes rectangular openings at the two sides which are substantially aligned with the burner boxes 11 and 28 and a generally centrally located front-to-rear elongated rectangular opening aligned with the elongated air intake opening of the exhaust enclosure 12 for receiving the air intake grating 13. The cover 19 is mechanically secured to the burner pans 20 and 21 by a plurality of fasteners 26 such as rivets or thread-cutting sheet metal screws. As best shown in FIGS. 2 and 4, the housing 17 is assembled to the combination of burner pans 20 and 21 and cover 19 by means of a plurality of threaded spring steel spacers 22 which are inserted into square holes 23 in the burner pans 20 and 21 and extend outwardly toward the side walls 24 of housing 17. Threaded fasteners 25 extend through the side walls 24 of the housing 17 and engage with the spacers 22 to mechanically fasten the housing 17 to the previously assembled combination of burner pans 20 and 21 and cover 19. Thus the burner pans 20 and 21 are fixedly mounted within the burner boxes 11 and 28 defined by the housing 17 and exhaust enclosure 12. The air intake opening of the exhaust enclosure 12, in the preferred embodiment, is in closely spaced parallel relation to and is substantially longitudinally coextensive with the burner pans 20 and 21.

As best shown in FIG. 4, the periphery of the burner pans 20 and 21 is sealed to the underside of the cover 19 by a flexible, heat resistant seal 29 inserted between a burner pan flange 30 and the underside of the cover 19. The burner pans 20 and 21 are thus effectively sealed from the burner boxes 11 and 28. As an alternate construction, it is anticipated that the cover 19 and burners pans 20 and 21 could be formed as a unitary part from a single sheet of metal. In this proposed alternate construction, the seal 29 would be eliminated.

Figure 8:
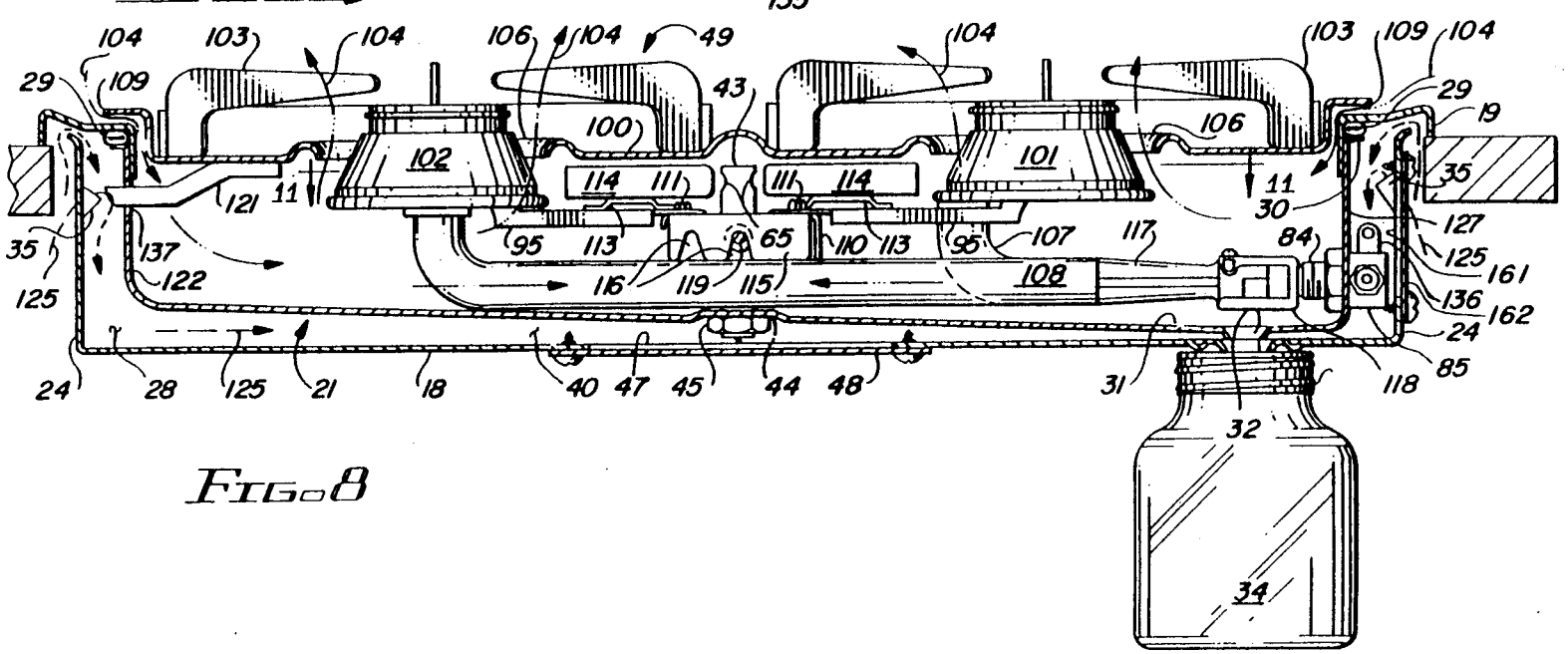
FIG. 8, shown with FIG. 3, is a section view taken generally along lines 8—8 of FIG. 2.
Figure 6:
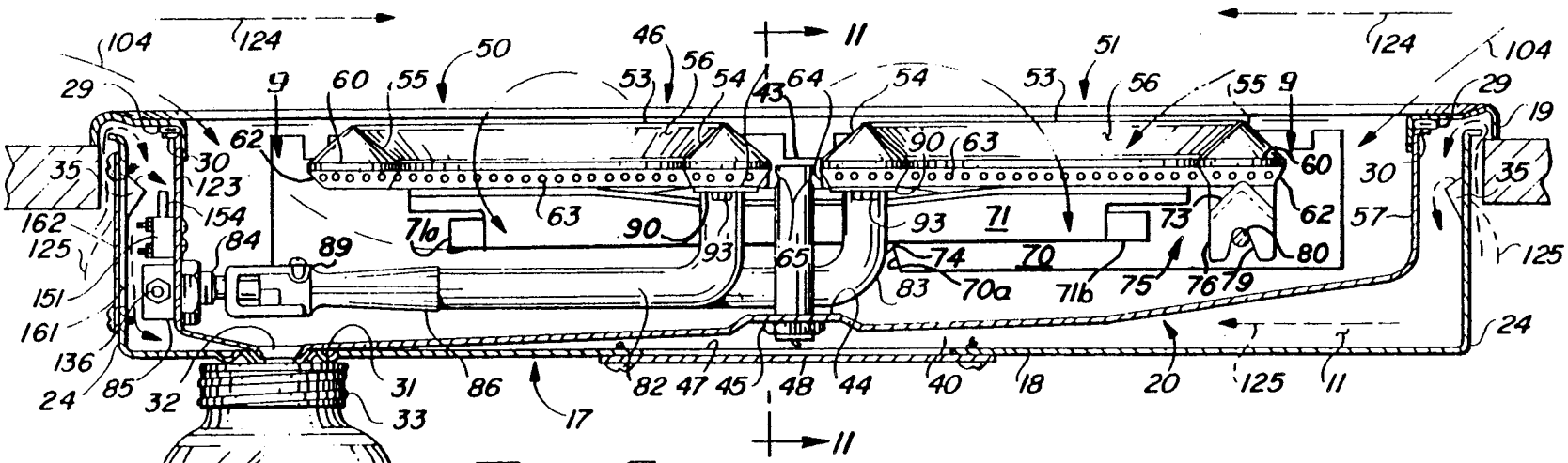
FIG. 6 is a section view taken generally along lines 6—6 of FIG. 2.

As best shown in FIGS. 2, 6 and 8, each burner pan 20 and 21 slopes downwardly from the rear toward the front of the countertop cooking unit 10 and includes a sump area 31. Each sump area 31 has a tube 32 which extends downwardly through the bottom wall 18 of the housing 17 and through jar lids 33 secured to the bottom wall 18. The jar lids 33 are threaded and each receives a jar or container 34 for collecting drippings and various cooking spills.

FIGS. 1, 2, 6 and 8 show that the outer periphery of the housing 17 includes a first plurality of louvers 35 in the walls 24 defining air inlets into the area of the burner boxes 11 and 28. The side walls 36 of the exhaust enclosure 12 form one side wall of each burner box 11 and 28 and include a second plurality of louvers 39 defining air outlets from the burner boxes 11 and 28 into the exhaust enclosure 12 as best shown in FIG. 2. Thus airflow channels 40 are established between the first and second plurality of louvers 35 and 39 which are isolated from the interior of the burner pans 20 and 21 and which are utilized for cooling the burner pans 20 and 21. When the exhaust blower 14 is operational, as shown in FIG. 2, cooling airflow will be drawn into the airflow channels 40 through the first plurality of louvers 35 to wash the walls of the burner pans 20 and 21 for removing heat therefrom. The cooling airflow will be drawn into the exhaust enclosure 12 through the second plurality of louvers 39 and will be discharged to atmosphere.

Turning now to FIGS. 2, 6 and 8, a spark igniter 43 is shown generally centrally located within each non-removable burner pan 20 or 21. Each spark igniter 43 is secured to a formed flat area 44 in the bottom wall of each burner pan 20 and 21 by means of a threaded fastener such as a jam nut 45 or other means of fastening engageable with the body of the spark igniter 43. The spark igniters 43 have a conductive outer casing which is effectively grounded to the burner pan 20 or 21 when the threaded fastener 45 is secured. The grill burner unit 46 (FIG. 6) and the surface burner unit 49 (FIG. 8) are each removable from their respective non-removable burner pans 20 and 21 without disturbing the spark igniters 43. A centrally located glow coil, glow bar or a standing pilot light can also be used in such grill ranges.

As best shown in FIGS. 6 and 8, the bottom wall 18 of each of the burner boxes 11 and 28 includes a generally rectangular access opening 47 directly below the igniters 43. The access opening 47 is normally closed by an access cover 48 held in place by sheet metal screws.

Figure 7:
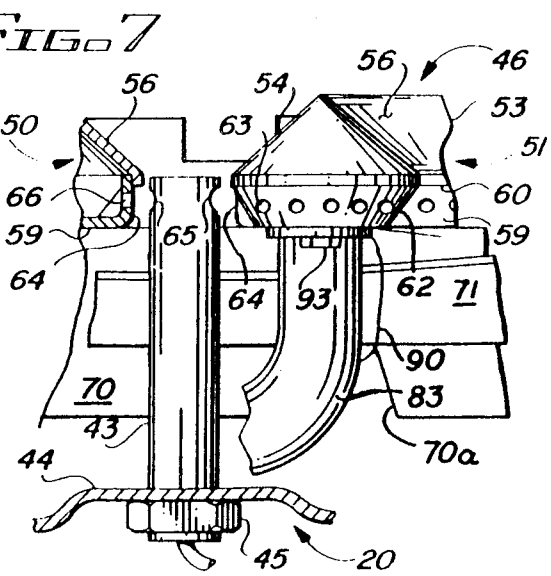
FIG. 7 is an enlarged fragmentary section view showing the mounting of the igniter and the charge port arrangement for the grill burner unit.
Figure 9:
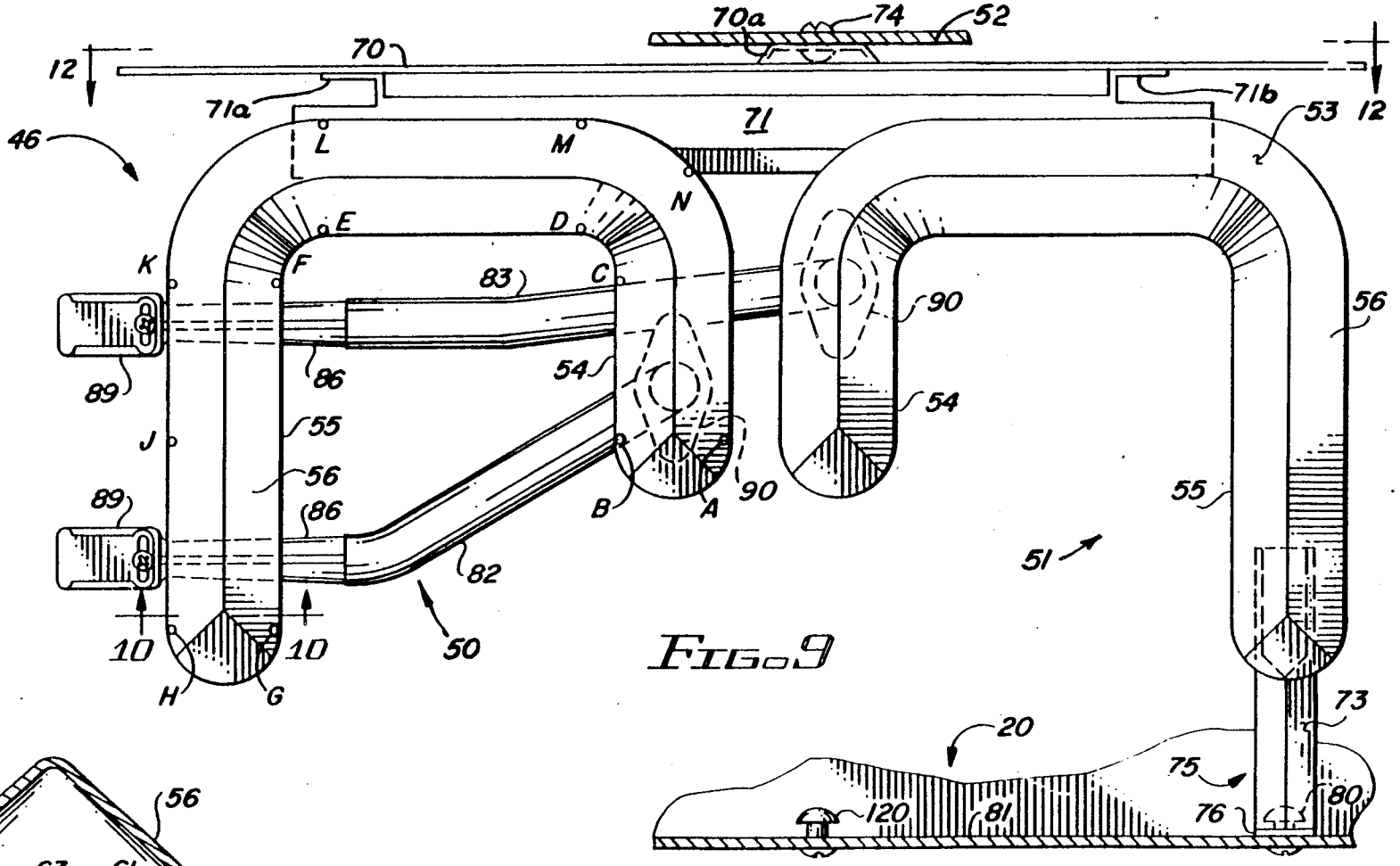
FIG. 9 is a view of the grill burner assembly of the invention taken generally along lines 9—9 of FIG. 6.

FIGS. 6, 7, 9 and 10 depict the grill burner unit 46 which is typically mounted exclusively within the left burner pan 20, and its various construction details. Burner pan 20 has a first side wall 81 adjacent the air inlet 13 of the exhaust enclosure 12 within the cooking unit 10 and a second wall 52 adjacent the outside of the housing of the cooking unit 10. The grill burner unit 46 shown in these drawings is particularly designed for use with a forced-air, downdraft ventilation system. As best shown in FIGS. 6, 7 and 9, the grill burner unit 46 is comprised of front and rear generally C-shaped gas burners 50 and 51 which are substantially mirror images of each other with the main body portions 53 located adjacent the second or outside wall 52 of the left burner pan 20, opposite the air intake grating 13 of the exhaust enclosure 12. The C-shaped gas burners 50 and 51 each include a body portion 53 generally parallel to the outside wall 52 of the left burner pan 20, a short leg 54 and long leg 55 substantially perpendicular to the body portion 53 so that the open portion of the C-shape faces the air intake grating 13 of the exhaust enclosure 12. The front and rear C-shaped burners 50 and 51 are individually controlled.

Figure 10:
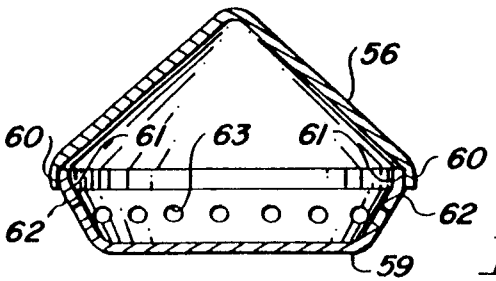
FIG. 10 is an enlarged cross sectional view taken through the grill burner unit along lines 10—10 of FIG. 9.

As best shown in cross section in FIG. 10, each of the C-shaped gas burners 50 or 51 have upper and lower formed sheet metal shells or halves 56 and 59. In the preferred embodiment, the C-shaped gas burners 50 and 51 are formed from stainless steel. As further shown in FIG. 10, the upper sheet metal shell or half 56 is formed in a tent or inverted V-shape to promote the drainage of grease and drippings as meat products are grilled. When viewing the cross section of FIG. 10, the tent-shaped upper sheet metal shell or half 56 includes a generally vertical downwardly extending lower wall portion or flange 60 which extends around the periphery of the C-shaped gas burners 50 or 51 as viewed in FIG. 9. The lower sheet metal shell or half 59 is substantially U-shaped in cross section and, as shown in FIG. 10, includes a generally vertical upwardly extending upper wall portion or flange 61 which extends around the periphery of the C-shaped gas burners 50 or 51 and which nests inside of the vertical lower wall portion or flange 60 of the upper sheet metal shell or half 56. The side walls 62 of the lower sheet metal shell or half 59 are inclined at approximately 30° to vertical and include a plurality of gas ports 63, which are spaced around the periphery of the gas burners 50 and 51. Gas ports 63 are clean cut holes generally free from burrs and formed substantially perpendicular to these side walls 62.

Referring now to FIG. 9 in particular, progressing around the periphery of the front burner 50 of the grill burner unit 46 and beginning at point A which is the location of the ignition charge port 66 shown in FIG. 7. In the preferred embodiment, from point A to point B, there are 14 gas ports 63 spaced at 0.137 inches apart. From point B to point C, there are 14 gas ports 63 spaced at 0.157 inches apart. From point C to point D, there are 4 gas ports 63 spaced at 0.233 inches apart. Between points D and E, there are 19 gas ports 63 spaced at 0.174 inches apart. From point E to point F, there are 4 gas ports 63 spaced 0.233 inches apart. Between points F and G, there are 27 gas ports 63 spaced at 0.171 inches apart. Between points G and H, there are 13 gas ports 63 spaced 0.137 inches apart. From point H to point J, there are 19 gas ports 63 spaced at 0.133 inches apart. All of the gas ports 63 between points A and J are formed by drilled openings 0.055 inches in diameter prior to formation of the shell.

Continuing around the periphery of the front burner 50, between points J and K, there are 11 gas ports 63 spaced at 0.205 inches apart. Between points K and L, there are 19 gas ports 63 spaced at 0.154 inches apart. From points L to M, there are 17 gas ports 63 spaced at 0.195 inches apart and between points M and N, there are 11 gas ports 63 spaced at 0.154 inches apart. All gas ports 63 between points J and N are formed by drilled openings 0.070 inches in diameter prior to formation of the shell. There are no gas ports 63 between points N and A. The same pattern of gas ports 63 is formed around the periphery of the rear burner 51 in a mirror image. The arrangement of the gas ports 63 provides for greater heat output between points J and N at the outside of burner 50 than between points A and J at the inside of burner 50. Also, there is no heat output between points A and N. Thus, relatively more heat is generated adjacent the left side wall 52 at the outside edge of cooking unit 10.

Figure 11:
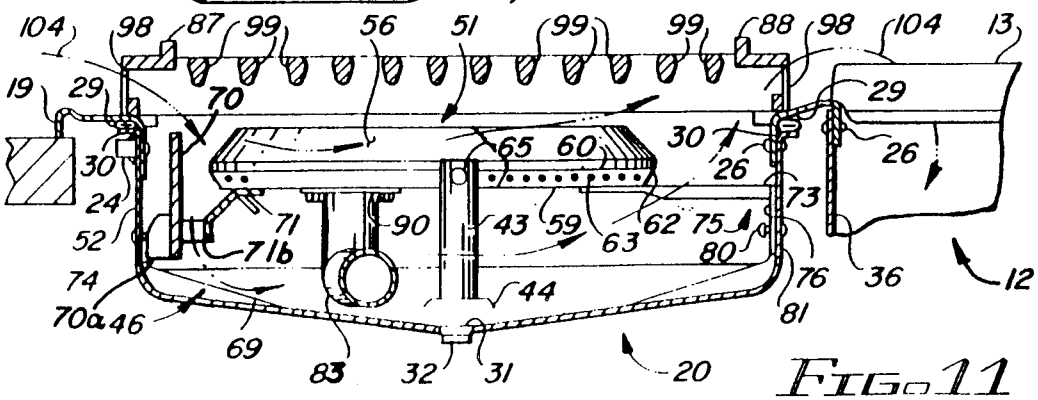
FIG. 11, shown with FIG. 6, is a section view of the left burner pan assembly and grate taken generally along lines 11—11 of FIG. 6.

Thus, as indicated above, burner 46 provides a substantial majority of the gas ports 63 adjacent the second or outside wall 52 of burner pan 20. In operation, burner 46 provides a substantially higher heat output adjacent the second or outside wall 52 of burner pan 20 than at the first or inside wall 81 of the burner pan to achieve fast effective cooking of food placed over burner 46 with the proximity ventilation system in operation. As shown in FIGS. 2 and 11, a grill grate 96, 97 is provided over burner 46 to support food to be grilled.

When the grill burner 46 is mounted in the left burner pan 20 as shown in FIGS. 1 and 6, the main body portions 53 of the gas burners 50 and 51 are juxtaposed to outside left wall 52 of the left burner pan 20. The exhaust blower 14 is operated whenever the grill burner unit 46 is in use so that heated air is continually drawn generally across and upwardly away from the grill burner unit 46 and eventually down into the exhaust enclosure 12. The physical location of the C-shaped gas burners 50 or 51 within the left burner pan 20, away from the enclosure 12, provides for controlled convective heating across the entire width of the left burner pan 20 and the grill grate 96 or 97 for preventing cold and hot spots. Due to the action of the exhaust blower 14 in drawing heated air across the left burner pan 20, little or no flame is required in the area directly adjacent the air intake grating 13 and thus, as previously discussed, the gas ports 63 have been arranged to provide relatively more heat output adjacent the outside side wall 52 of the left burner pan 20.

In accordance with the invention, burner assembly 46 is provided, as shown in FIGS. 1, 2, 5, 6, 7, 9, 11 and 12, with baffle means 70 carried by burner 46 intermediate the burner 46 and wall 52 of the burner pan. The baffle means 70 is adapted to intercept heat radiated by the burner 46 and to control, and be cooled by, the flow of air generated by operation of the burner 46.

As shown in FIGS. 1, 2, 6, 9, 11 and 12, baffle means 70 preferably extends substantially coextensively between burner 46 and burner pan side wall 52. Baffle means 70, as best shown in FIGS. 5, 9, 11 and 12, can comprise a portion 70*a* engaging the burner pan 20 and removably supporting the burner 46 within said burner pan 20. As shown in FIGS. 6, 9 and 11, portion 70*a* can comprise a slot formed in the baffle means and adapted to engage a portion of burner pan 20. Preferably, the portion of baffle means 70 adjacent slot 70*a* is deformed by bending the slot-forming portion of the baffle means, which can otherwise comprise a long flat metal plate, out of the plane of the baffle means, as shown in FIGS. 5, 9, 11 and 12. In the embodiment shown and described, burner pan 20 is provided with a small projection 74, which may be a rivet, threaded fastener or other rod-like projection supported by side 52 of burner pan 20, and the deformed, slot-forming portion 70*a* of baffle means 70 is placed so that slot-forming portion 70*a* rests on projection 74 to support burner 46 adjacent side 52 of burner pan 20.

In the embodiment shown and described, baffle means 70 is supported from burner 46 by a flange 71 forming a pair of small flanges 71*a* and 71*b*, as shown in FIGS. 6, 9 and 11. The small flanges 71*a* and 71*b* are L-shaped projections of the elongated flange 71, which extends along and supports the back portions of the two generally C-shaped burners 50 and 51. Baffle means 70 is thus carried outwardly of burner 46 by a supporting means, including flange 71 and flanges 71*a* and 71*b*, which has a reduced thermal conductivity. The side of cooking unit 10 is thus isolated from heat transfer by thermal conductance by the supporting means of reduced thermal conductivity and the substantially point contact between slot-forming portion 70*a* of baffle means 70 and projection 74 of burner pan 20.

As further shown in FIGS. 6 and 9, a second bracket 75 is likewise secured to the bottom of the long leg 55 of the rear C-shaped gas burner 51 and includes an arm 73 formed from inverted V-shaped channel stock for promoting grease drainage. The second bracket 75 extends outwardly from the long leg 55 of the rear C-shaped gas burner 51 and, as best shown in FIG. 6, has a downwardly opening slot 79 for receiving a mounting stud 80 attached to the right side wall 81 of the left burner pan 20. The rearwardly offset positioning of the right mounting stud 80 and second bracket portion 75 from the slot-forming portion 70*a* of baffle means 70 enhances the stability of the grill burner unit 46 when mounted within the left burner pan 20.

Thus, the burner assembly, or grilling means 46, is removably supported within the burner pan 20 and may be easily removed from burner pan and replaced with surface units like the units 101 and 102 shown in FIGS. 1 and 8.

As best shown in FIGS. 1 and 2, the frame-like cover 19 supports a pair of grill grates 96, which are fabricated from rod stock, over the grill burner unit 46. In order to meet testing agency requirements the gas downdraft countertop cooking unit 10 must be able to continually draw air into the burner pan 20 even if the grill grates 96 are completely covered as with a flat cookie sheet or griddle, for example. As shown in FIGS. 1 and 2, by the triple dot-solid line arrows 104, combustion air will be drawn into the burner pan 20 along the edges of the grill grates 96 which are elevated with respect to the cover 19.

FIG. 11 depicts a preferred grill grate embodiment incorporating cast aluminum grill grates 97. The cast aluminum grill grates 97 have openings 98 on each side of the burner pan 20 which are sized to provide about 6.5 square inches of intake area and allow a controlled optimum volume of air to be drawn into the left side of the burner pan 20. The openings 98 extend from front to rear and generally parallel with the air intake grating 13. Combustion air depicted by the triple dot-solid line arrows 104 enters the burner pan 20 through the opening 98 on the left side as shown in FIG. 11.

Baffle means 70 lies in the path of the flow of combustion air induced by operation of burner 46. As described above, baffle means 70 extends substantially coextensively of the burner 46 and is located to intercept and retard airflow to burner 46 from adjacent side 52 of the burner pan 20 to improve the gas flame characteristics at the main portions 53 of burners 50 and 57. Baffle means 70 intercepts the heat radiation from burner 46 in the direction of side wall 52 and is cooled by convective heat transfer to the flow of air 104 to reduce the baffle means temperature and the radiant transfer of heat between baffle means, 70 and side wall 52 of burner pan 20.

Baffle means 70 thus substantially reduces heat transfer to and the temperature of the side of cooking unit 10 adjacent the high heat output of burner 46. Baffle means 70 also retards airflow adjacent the side wall 52 to achieve improved flame characteristics adjacent the baffle 70 for retaining maximum heat in the vicinity of the main body portions 53 of the burners 50 and 51. In other words, the baffle means 70 prevents the flame from being pulled under the burners 50 and 51 by the velocity of combustion air 104 pulled into the burner pan 20 through openings 98. This permits convective heat thermals to rise in a substantially vertical path in the area superjacent the burners 50 and 51. As further shown in FIG. 11, the cast aluminum grates 97 further include front-to-rear extending upwardly projecting ribs 87 and 88. As air is drawn from the surface of the grates 97, the left rib 87 will initially retard and deflect the air in an upward direction to enhance the convective airflow above the grill burner unit 46.

A cooking apparatus of the invention thus includes a cooking or grilling means, particularly adaptable for proximity ventilated cooktops, comprising a heater producing a high heat output and a baffle carried outwardly of the heater on at least one side thereof and extending on at least one side substantially the entire width and height of the heater. Such a baffle can intercept substantially the heat radiated by the heater in the direction of the baffle and can be located so it also intercepts air flow generated in operation of the apparatus.

The drawings and specification set forth a preferred embodiment of the invention, and although specific terms are employed, they are not used for purposes of limitation. Changes in the form and proportion of parts and the substitution of equivalents will be apparent to those skilled in the art and will not depart from the scope of the invention as defined in the following claims.

We claim:

1. A removable grilling means for a proximity ventilated grill range, comprising a burner for grilling foods, said burner being adapted to be removably supported within a burner pan generally along its centerline and having a substantially greater heat output on one side of said burner pan centerline; first baffle means adjacent said burner on said one side;

and second baffle means carried by said burner on said one side of said centerline and intermediate said burner and said burner pan, said second baffle means being adapted to intercept heat radiated by said burner and to control, and be cooled by, the flow of air generated by operation of said grill range.

2. The removable grilling means of claim 1 wherein said second baffle means extends substantially coextensively between said burner and said burner pan on said one side of said burner pan and comprises a portion engaging said burner pan and removably supporting said removable grilling means within said burner pan.

3. The removable grilling means of claim 2 wherein said first baffle means is attached to said burner and said second baffle means is a long flat steel plate rigidly supported by a pair of flanges extending from said first baffle means and includes a slot adapted to engage a supporting projection of the burner pan.

4. The removable grilling means of claim 1 wherein said burner includes primary and secondary body portions forming an unsymmetrical burner with said primary body portion being disposed on said one side of said burner pan centerline.

5. The removable grilling means of claim 1 wherein said burner is a gas burner with gas ports arranged and sized to provide greater heat output on said one side of said burner pan centerline.

6. The removable grilling means of claim 5 wherein said second baffle means extends substantially coextensively of said burner and is located to intercept and retard airflow to said burner from adjacent said one side of said burner pan to improve the gas flame characteristics on said one side of said centerline.

7. The removable grilling means of claim 1 wherein said burner includes front and rear generally C-shaped gas burners, each having a main body portion laterally offset from, and on said one side of, said centerline of said burner pan.

8. The removable grilling means of claim 7 wherein said front burner is a mirror image of said rear burner and said front an drear burners are adapted for individual control.

9. A cooking appliance having a housing defining a burner pan with first and second side walls, proximity ventilation means having an air inlet extending along said first side wall, a grill overlying said burner pan, a heater mounted in said burner pan for producing a predetermined heat output, first baffle means attached to said heater adjacent and spaced from said second side wall, and second baffle means supported in said burner pan intermediate and spaced from said first baffle means and said second side wall, said second baffle means extending substantially coextensive with the length and height of said heater and forming a radiant shield between said second side wall and said heater and with said second side wall in an airflow path for effectively thermally isolating said housing from said heater.

10. The cooking apparatus of claim 9 wherein said second baffle means is supported and carried by said first baffle means outwardly of said heater to provide a heater-baffle means assembly that is removable as a unit from said burner pan to permit easy cleaning of said burner pan and replacement of said heater-baffle means assembly with one or more surface burners.

11. The cooking apparatus of claim 10 wherein said second baffle means is connected to and carried by said first baffle means with a support of reduced thermal conductivity.

12. The cooking apparatus of claim 9 wherein said second baffle means comprises a portion adapted to engage a portion of said burner pan to support the heater-baffle means assembly.

13. The cooking apparatus of claim 12 wherein said burner pan includes a projecting portion and said second baffle means comprises a slotted portion adapted to engage and rest on the projecting portion of said burner pan.

14. A removable cooking means for a cooking apparatus, comprising an unsymmetrical gas heater adapted to produce greater heat output on one side than on the other side and a baffle means including a first flame control portion on said heater and a second portion carried outwardly of said heater on said one side and extending substantially the entire width and height of the heater on said one side of the heater.

15. A removable heater assembly for a cooking apparatus, comprising a heater having a high heat output, a first baffle means attached to said heater, and a second baffle means carried by said first baffle means outwardly of said heater on at least one side thereof in position to intercept substantially the heat radiated by said heater to said at least one side.

16. The heater assembly of claim 15 wherein said second baffle means comprises a plate extending substantially the entire width and height of the heater.

17. The heater assembly of claim 15 wherein said heater is unsymmetrical and produces greater heat output on one side than on the other side and wherein said second baffle means is carried outwardly of said one side producing greater heat output.

18. The heater assembly of claim 15 wherein said second baffle means is carried outwardly of said heater by a bracket interconnecting said first and second baffle means and said heater into an integral replaceable unit.

19. The heater assembly of claim 18 wherein said bracket is adapted to provide low conductive heat transfer from said heater to said second baffle means.

20. The heater assembly of claim 15 wherein said second baffle means is in a position to be cooled by air flow generated in the operation of the cooking apparatus.

21. A removable grilling means for a proximity ventilated grill range, comprising a burner for grilling foods, said burner being adapted to be removably supported within a burner pan generally along its centerline and having a substantially greater heat output on one side of said burner pan centerline;

and baffle means carried by said burner on said one side of said centerline intermediate said burner and said burner pan and substantially coextensive therewith, said baffle means comprising a long flat steel plate rigidly supported from said burner by a pair of flanges extending from the burner and including a slot formed in a projecting deformation of said steel plate for engaging a supporting projection of said burner pan to removably support said removably grilling means within said burner pan, said baffle means being adapted to intercept heat radiated by said burner and to control, and be cooled by, the flow of air generated by operation of said grill range.

22. A removable cooking means for a cooking apparatus, comprising an unsymmetrical heater adapted to produce greater heat output on one side than on the other side;

and a baffle means carried outwardly of said heater on said one side by supporting means of reduced thermal conductivity, said baffle means including a heater supporting portion comprising a slotted deformation adapted to engage a projection of the cooking apparatus, said baffle means extending substantially the entire width and height of the heater.

23. The cooking apparatus of claim 22 wherein said heater is provided with detachable connections to a source of heat energy and with additional supporting means adapted to engage the cooking apparatus.

* * * * *